United States Patent [19]

Cardan

[11] Patent Number: 5,048,498

[45] Date of Patent: Sep. 17, 1991

[54] FUEL LINE CONDITIONING APPARATUS

[76] Inventor: Alan Cardan, 433 E. Lorraine St., Glendale, Calif. 91207

[21] Appl. No.: 565,552

[22] Filed: Aug. 10, 1990

[51] Int. Cl.[5] ..... F02B 75/00

[52] U.S. Cl. ..... 123/538; 123/536

[58] Field of Search ..... 123/536, 537, 538

[56] References Cited

U.S. PATENT DOCUMENTS

| | | | |
|---|---|---|---|
| 3,349,354 | 10/1967 | Miyata | 123/538 |
| 4,461,262 | 7/1984 | Chow | 123/538 |
| 4,572,145 | 2/1986 | Mitchell et al. | 123/536 |
| 4,803,306 | 2/1989 | Mitchell et al. | 123/538 |

FOREIGN PATENT DOCUMENTS

| | | | |
|---|---|---|---|
| 2122253 | 1/1984 | United Kingdom | 123/536 |

*Primary Examiner*—Andrew M. Dolinar
*Assistant Examiner*—M. Macy
*Attorney, Agent, or Firm*—Poms, Smith, Lande & Rose

[57] ABSTRACT

A fuel conditioning apparatus for use in improving the fuel efficiency of car engines, heaters, furnaces and the like includes a housing, a cover, affixing means for attaching the housing to the fuel intake line, and conditioning means for magnetically aligning the flowing hydrocarbon fuel mixture molecules. The conditioning means includes a plurality of magnets which form a focused magnetic field to polarize and align the fluid flow within the fuel line.

4 Claims, 1 Drawing Sheet

FUEL LINE CONDITIONING APPARATUS

INTRODUCTION

Generally stated, the present invention relates to hydrocarbon combustion in internal combustion engines, and more particularly to an apparatus that magnetically conditions molecules of a fuel mixture.

BACKGROUND OF THE INVENTION

The twin problems of fossil fuel shortage and environmental damage due to the combustion of fossil fuels has created an increasing demand for higher efficiency internal combustion engines for motor vehicles. The higher efficiency engine would require less fuel to operate because it would obtain increased energy conversion efficiency from an identical amount of fuel used for a low efficiency engine. Consequently, less unburned fuel in the form of hydrocarbons enters the atmosphere along with the other exhaust gases, typically CO, $CO_2$ and $NO_2$. The level of environmental pollution in the form of photochemical smog would consequently be reduced since such smog is caused by ultraviolet radiation of unburned hydrocarbons in the atmosphere.

There have been prior art devices commercially available which have been directed to improving combustion efficiency. However, most of the prior art devices require modification to the carburetor, fuel injection or induction system of the internal combustion engine. These modifications may void the manufacturer's warranty, especially as directed to emission control devices, and may further be non-certifiable or unlawful under various state and federal emission control or atmospheric quality regulations.

Therefore, it would be advantageous for motor vehicle owners to simply attach an inexpensive fuel conditioning apparatus to the fuel lines of their automobile engines which would improve the fuel efficiency of the engine without voiding the warranty or operating unlawful equipment. It would also be desirable to be able to attach the fuel conditioning apparatus simply and without the need for tools.

SUMMARY OF THE INVENTION

It is therefore a primary object of the present invention to provide a fuel conditioning apparatus for an internal combustion engine of the type used in a motor vehicle that improves its fuel efficiency. It is also an object of the present invention to provide an apparatus that magnetically conditions the molecules of a fuel mixture flowing through the fuel line thereby aligning the molecules. It is yet another object of the present invention to provide a fuel conditioning apparatus which can be easily installed without the need for tools.

Generally stated, the present invention includes a housing, a cover, affixing means for attaching the housing to the fuel intake line of the engine, and conditioning means for magnetically aligning the molecules of a fuel mixture. In one particular embodiment of the present invention, the conditioning means includes a plurality of magnets which form a focused magnetic field to polarize and align the flowing molecules of a fuel mixture.

A more complete understanding of the fuel conditioning apparatus of the present invention will be afforded to those skilled in the art, as well as a realization of additional advantages and objects thereof, by a consideration of the following detailed description of a preferred exemplary embodiment. Reference will be made to the appended sheets of drawings which will be first described briefly.

DETAILED DESCRIPTION OF A PREFERRED EXEMPLARY EMBODIMENT

Figure 1:
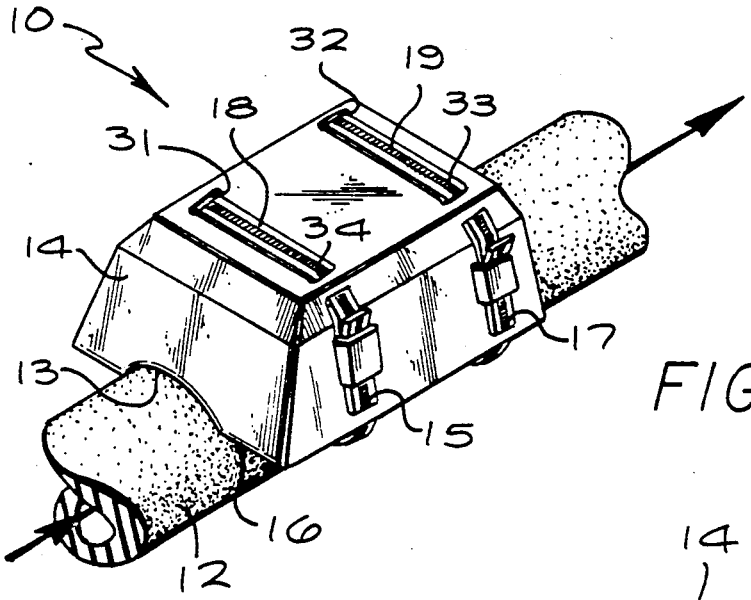
FIG. 1 is a perspective view of an exemplary fuel intake line installation of a preferred exemplary embodiment of the fuel conditioning apparatus of the present invention.

Referring to FIG. 1, a preferred exemplary embodiment of a fuel conditioning apparatus in accordance with the present invention is illustrated, shown generally at 10, affixed to fuel intake line 12. The exemplary fuel conditioning apparatus 10 has a rectangular box housing 14, and a bottom cover 16. The bottom cover 16 has an elongated semicircular depression 13 which cooperates with the shape of the fuel line 12, so that the apparatus may easily attach to the fuel line 12.

It is anticipated that housing 14 and cover 16 be manufactured from a molded plastic material or other suitable non-ferromagnetic material. It is also anticipated that bottom cover 16 be permanently sealed to housing 14 by the manufacturer since proper positioning of the apparatus' internal components is critical to the proper operation of the apparatus. By sealing the apparatus, the user is insured that the internal components will remain in their correct position.

The apparatus has an affixing means to rigidly affix the housing 14 to the fuel intake line 12. To provide the affixing means, a plurality of parallel depressions, shown at 31, 32, 33 and 34, are integrally molded to the housing 14 and provide a guide path for the affixing straps 18 and 19 which surround the housing and fuel line 12, rigidly holding the housing in place. It is anticipated that a commercially available strap connecting means be utilized, known as a tie wrap, shown as 15 and 17. Such a connecting means could enable the user to easily mount the fuel conditioning apparatus to the fuel line without the need for tools.

Figure 2:
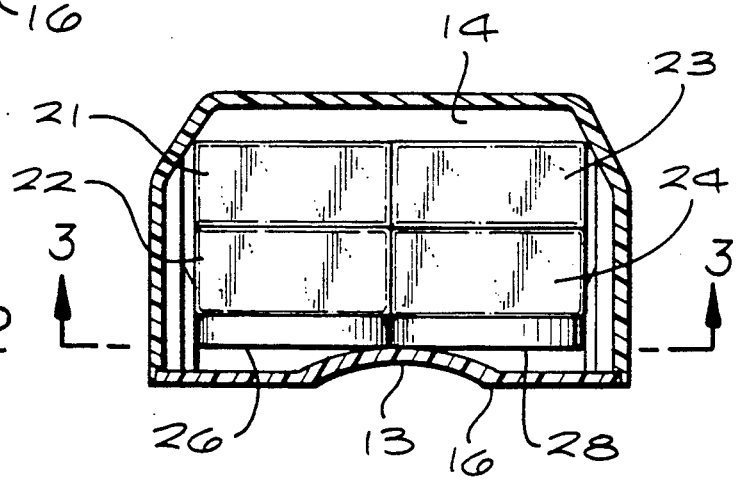
FIG. 2 is a sectional side view showing the interior of the fuel conditioning apparatus, as revealed by the section 2—2 taken in FIG. 3.
Figure 3:
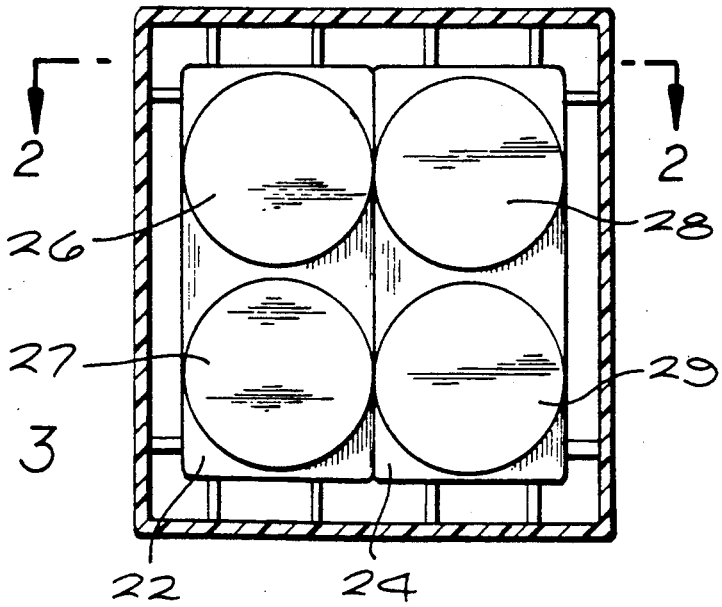
FIG. 3 is a sectional bottom view showing the interior of the fuel conditioning apparatus, as revealed by the section 3—3 taken in FIG. 2.

The fuel conditioning apparatus 10 has a conditioning means for magnetically aligning the molecules of a fuel mixture passing through the fuel line 12. The exemplary conditioning means includes a plurality of magnets which form a focused magnetic field to polarize the molecules of a fuel mixture in the fuel line 12, further causing alignment of the molecules. FIGS. 2 and 3 exemplarily show the plurality of magnets, rigidly mounted in an internal cavity within housing 14. A first pair of rectangular magnets 21 and 22 are shown stacked in polar alignment. Directly adjacent to the first pair are a second pair of rectangular magnets 23 and 24, also stacked in polar alignment. The two pairs are positioned such that the polarity of the magnetic fields are in the same direction. Normally this would cause the two pairs to repel each other, however, the housing maintains the magnet pairs in proximity.

Below each rectangular magnet pair, are a pair of disk magnets. Disk magnets 26 and 27 are positioned below rectangular magnet 22, as best shown in FIG. 3.

The polarity of disk magnets 26 and 27 are in the same direction as magnetic pair 21 and 22, such that the magnetic field of the stack combines. Similarly, disk magnets 28 and 29 are positioned below rectangular magnet 24, also with polarity in the same direction as magnetic pair 23 and 24. As described hereinabove, the housing 14 prevents the normally repelling disk magnets from altering position.

With the plurality of magnets rigidly held in place, a net positive magnetic field is formed directly below housing 14. This field is focused, by the use of the disk magnets described above, onto a position corresponding with the center of the fuel line 12. This focused field overcomes the net negative charge of the flowing molecules, further causing alignment of the molecules.

Having thus described a preferred exemplary embodiment of a fuel conditioning apparatus in accordance with the present invention, it should be apparent to those skilled in the art that the aforestated objects and advantages for the herein described apparatus have been achieved. It should also be appreciated by those skilled in the art that various modifications, adaptations and alternative embodiments thereof may be made within the scope of the present invention which is defined by the following claims.

What is claimed is:

1. A fuel conditioning apparatus for an internal combustion engine, said apparatus comprising:

fuel conditioning means for magnetically aligning the molecules of a hydrocarbon fuel mixture passing through a fuel intake of said engine, said conditioning means having a plurality of magnets; and a housing to maintain said plurality of magnets in rigid position; and means for affixing said housing to said fuel intake line, said plurality of magnets forming a focused magnetic field, said field polarizing said fuel mixture thereby causing alignment of said molecules;

said plurality of magnets further including a first pair of rectangular magnets stacked in polar alignment, a second pair of rectangular magnets stacked in polar alignment, a first and second disk magnet adjacently placed on said first pair in polar alignment with said first pair, a third and fourth disk magnet adjacently placed on said second pair in polar alignment with said second pair, said first pair positioned adjacent to said second pair with polarity of said first pair and second pair in the identical direction; and said polarity of said plurality of magnets is of a positive degree of flux.

2. The apparatus of claim 1, wherein:

said housing has a cavity to rigidly engage said plurality of magnets, a cover to enclose said cavity, and a plurality of external parallel depressions to engage said affixing means, the exterior of said cover having an elongated semicircular depression for attachment to said fuel intake line.

3. The apparatus of claim 2, wherein:

said affixing means has a plurality of straps which engage said parallel depressions and bind said housing to said fuel intake line.

4. The apparatus of claim 3, wherein said housing is of a molded plastic material.

* * * * *